US007623019B2

(12) United States Patent
Luo

(10) Patent No.: US 7,623,019 B2
(45) Date of Patent: Nov. 24, 2009

(54) VARISTOR WITH THREE PARALLEL CERAMIC LAYER

(75) Inventor: Lang Rih Luo, Hsinchu County (TW)

(73) Assignee: Energetic Technology Co., Hsinchu (TW)

( * ) Notice: Subject to any disclaimer, the term of this patent is extended or adjusted under 35 U.S.C. 154(b) by 449 days.

(21) Appl. No.: 11/429,073

(22) Filed: May 8, 2006

(65) Prior Publication Data

US 2007/0103268 A1 May 10, 2007

(51) Int. Cl.
*H01C 7/10* (2006.01)

(52) U.S. Cl. ..... 338/21; 338/20; 252/518.1; 361/117

(58) Field of Classification Search ..... 338/21, 338/20, 314; 252/518.1, 521.5; 361/117, 361/127

See application file for complete search history.

(56) References Cited

U.S. PATENT DOCUMENTS 4,296,002 A * 10/1981 Sokoly et al. ..... 252/518.1
4,423,404 A * 12/1983 Goedde et al. ..... 338/21
4,616,286 A 10/1986 Breece
5,115,221 A 5/1992 Cowman
5,130,884 A * 7/1992 Allina ..... 361/117
5,155,464 A 10/1992 Cowman et al.
5,235,310 A * 8/1993 Cowman et al. ..... 338/21
5,608,596 A 3/1997 Smith et al.
6,159,768 A 12/2000 Ahn
6,183,685 B1 2/2001 Cowman et al.
6,477,025 B1 11/2002 Goldbach et al.

FOREIGN PATENT DOCUMENTS

JP 1146305 6/1989
JP 2003009387 1/2003
JP 2006109681 4/2006
SU 1737613 5/1992

* cited by examiner

*Primary Examiner*—Kyung Lee
(74) *Attorney, Agent, or Firm*—Bacon & Thomas, PLLC

(57) ABSTRACT

The present invention discloses a varistor which comprises three parallel ceramic layers. Each of the ceramic layers has two electrodes on both sides thereof. Four leads are properly arranged between and outside surfaces of the ceramic layers to contact with these electrodes. By further providing one or two wires to connect these leads, the three- or single-phase power sources can be protected in a safer manner.

8 Claims, 2 Drawing Sheets

(A)

| | Before shorting | After shorting |
|---|---|---|
| a-b | 1004 pF | 1520 pF |
| c-d | 1008 pF | 1525 pF |
| a-d | 1015 pF | 1506 pF |
| | * Vb=200V | |

(B)

VARISTOR WITH THREE PARALLEL CERAMIC LAYER

BACKGROUND OF THE INVENTION

1. Field of the Invention

The present invention relates to a varistor or surge absorber, and more particularly to a varistor has three parallel ceramic layers for protecting a single- or three-phase circuit.

2. Related Prior Arts

FIG. 1 shows a conventional varistor. The varistor includes a zinc oxide ceramic 11 with two electrodes 12 on both sides thereof. The electrodes are normally made from silver and two leads 13 are welded thereon. The leads 13 are normally tin-coated copper wires. The varistor is further coated and packaged with epoxy powder for insulation. The zinc oxide ceramic 11 with grain boundary can protect a circuit from surge by transforming the electrical energy into heat dissipation. The relationship of heat generation (H), Cp specified heat coefficient of material, total mass (m) and temperature gradient ($\Delta T$) is based on the principle: $H=Cp\times m\times\Delta T$. That is, temperature gradient ($\Delta T$) will be smaller for a surge-absorber with larger mass (m) when the same heat is supplied.

On the other hand, resistance of the varistor will decrease with increasing of the temperature, and thus current leakage increases. If heat generation is larger than heat dissipation overtime, the zinc oxide ceramic will worsen or even flame up due to local high heat. Such situation is very dangerous for users and circumambience and should be avoided.

FIG. 2 shows three traditional surge absorbers 21, 22, 23 to protect the L-N-G power source, in which the varistor 21 operates on the L-N line, the varistor 22 operates on the N-G line and the varistor 23 operates on the L-G line. Since the three varistors operate independently, therefore the heat generated during surge has to be diffused from the respective varistor.

FIG. 3 shows the surge absorber disclosed in R.O.C. Patent No. 591837, in which the ceramic (e) comprises four terminals (a)~(d) as shown in (A), or three terminals when the terminals (b) and (c) are shorted. Though such design may protect the L-N-G power source, capacitances between the terminals are significantly increased by 50% after connecting the terminals (b) and (c), as shown in (B). In other words, the series or parallel association of the ceramic (e) results in that capacitive reactance decreases by 66% as the capacitance increases by 50%. If an alternating current is supplied, current leakage will increase and the device will be damaged. The tests regarding this device also indicate that the electrodes thereof do not operate independently.

To solve the above problem, the present invention thus provides an improved varistor.

SUMMARY OF THE INVENTION

One object of the present invention is to provide a varistor (or surge absorber), which can independently protect individual circuit lines of a three-phase power source.

Another object of the present invention is to provide a varistor, which can integrally protect the lines of a single-phase power source.

A further object of the present invention is to provide a varistor, which has a normally functional breakdown voltage and operates at a lower temperature.

The varistor of the present invention comprises three parallel ceramic layers each having two electrodes disposed on both sides, and a plurality of leads properly connecting these electrodes to form a three- or single-phase varistor.

DETAILED DESCRIPTION OF THE PREFFERED EMBODIMENTS

To describe the present invention in detail, the preferred embodiments are illustrated with the drawings.

Figure 1:
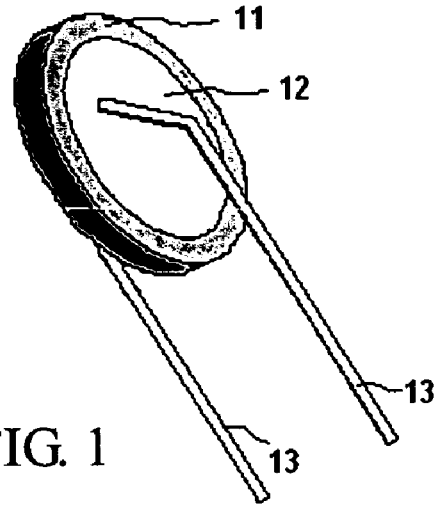
FIG. 1 shows a conventional varistor.
Figure 2:
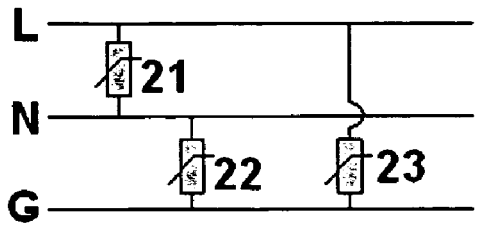
FIG. 2 shows three traditional surge absorbers to protect the L-N-G power source.
Figure 3:
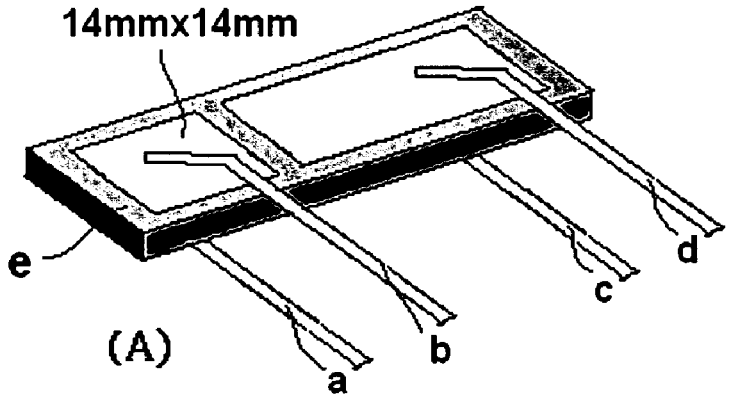
FIG. 3 shows the surge absorber disclosed in an R.O.C. Patent.
Figure 4:
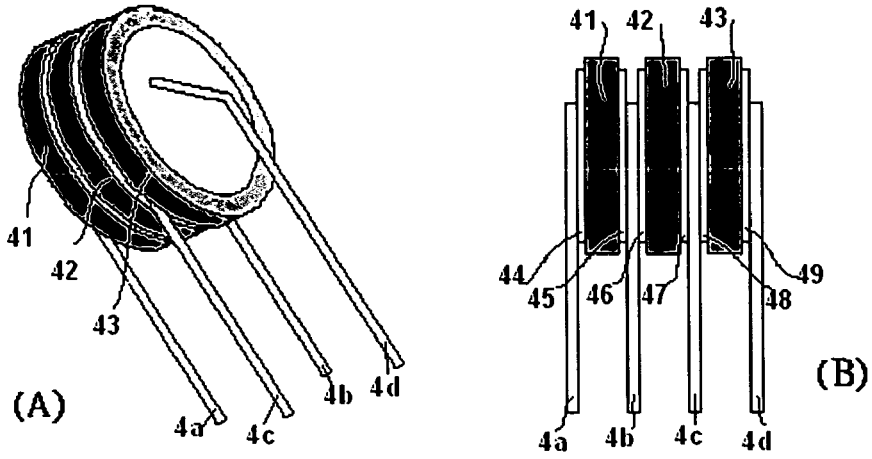
FIG. 4 illustrates the perspective and cross-section views of the varistor in accordance with the present invention.

In FIG. 4, (A) and (B) are respectively a perspective view and a cross-section view of a varistor in accordance with the present invention. The varistor is composed of three ceramic layers, six electrodes and four leads.

The three ceramic layers are integrated in parallel and sequentially defined as the 1st varistor 41, the 2nd varistor 42, and the 3rd varistor 43. Each of the ceramic layers 41~43 can provide an independent path for surge as the conventional varistor. The ceramic layers are preferably made of metal oxide powder, for example, zinc oxide. The ceramic layers can be shaped as desired, for example, disk-shaped, square, spherical, etc. The ceramic layers can be combined in any proper ways, for example, contacting each other with an adhesion, or formed integrally.

Among the six electrodes, the 1st electrode 44 and the 2nd electrode 45 are respectively disposed on two opposite surfaces of the 1st varistor 41; the 3rd electrode 46 and the 4th electrode 47 are respectively disposed on two opposite surfaces of the 2nd varistor 42; and the 5th electrode 48 and the 6th electrode 49 are respectively disposed on two opposite surfaces of the 3rd varistor 43. Relatively, the 3rd electrode 46 is adjacent to the 2nd electrode 45; and the 5th electrode 48 is adjacent to the 4th electrode 47.

The four leads are defined as the 1st lead 4*a* welded to the 1st electrode 44, the 2nd lead 4*b* welded to the 2nd electrode 45 and the 3rd electrode 46, the 3rd lead 4*c* welded to the 4th electrode 47 and the 5th electrode 48, and the 4th lead 4*d* welded to the 6th electrode 49.

Figure 5:
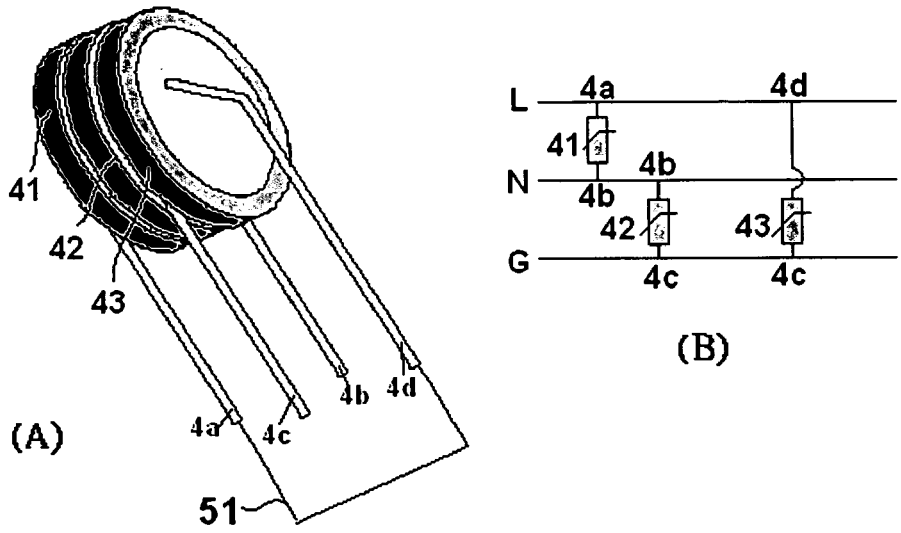
FIG. 5 illustrates the connection of the leads and an equivalent circuit for protecting a three-phase power source.

In FIG. 5, (A) and (B) respectively illustrate connection of the leads and an equivalent circuit for protecting a three-phase power source, in which the leads 4*a* and 4*d* are connected with a wire 51. Therefore, the varistor 41 may protect the L-N circuit, the varistor 42 may protect the N-G circuit, and the varistor 43 may protect the L-G circuit. Though each varistor operates independently, heat generated by one varistor can be transferred to the others. In other words, the varistor can remain a lower temperature during surge since a larger mass and a wider surface area are provided for heat generation and transfer.

Figure 6:
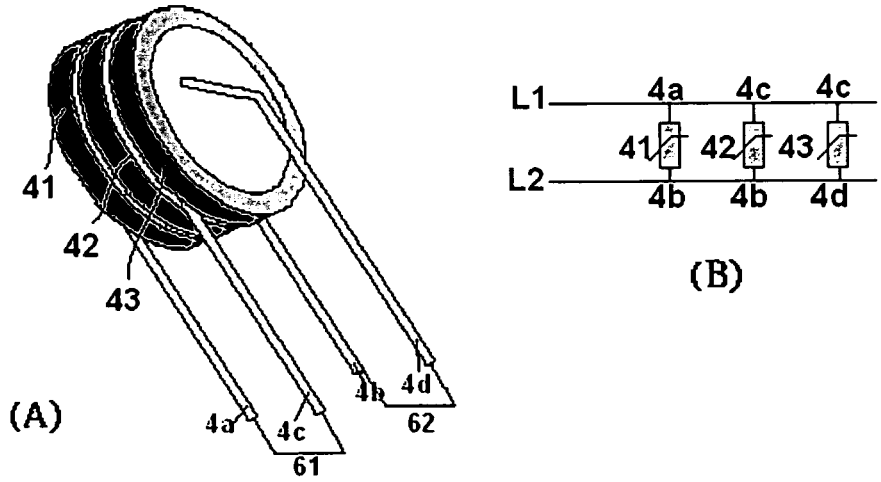
FIG. 6 illustrates the connection of the leads and an equivalent circuit for protecting a single-phase power source.

In FIG. 6, (A) and (B) respectively illustrate connection of the leads and an equivalent circuit for protecting a single-phase power source, in which the leads 4*a* and 4*c* are connected with a wire 61, and the leads 4*b* and 4*d* are connected with a wire 62. As a result, the ceramic layers 41, 42, 43 may together protect the circuit between L1 and L2. Since the three ceramic layers operate as a whole, protection effect for surge is promoted, and the temperature is also remained lower.

In accordance with the structure of the present invention, methods for producing the varistor are not restricted, but able to properly arrange and combine the ceramic layers, electrodes and leads. Furthermore, the ceramic layers, electrodes and leads can be arranged in different orders or positions optionally.

As described in the above, the varistor of the present invention performs advantages as follows:

1. The varistor of the present invention provides a larger mass and surface area for heat absorption and dissipation and is obviously safer and more durable than the conventional.

2. The three parallel ceramic layers of the varistor can independently operate on respective circuit lines of a three-phase power source.

3. The three parallel ceramic layers of the varistor can integrally operate on the circuit lines of a single-phase power source.

4. Rated working voltage for the individual circuit lines can be adjusted optionally, for example, a higher breakdown voltage for grounding.

5. The varistor needs less leads than the conventional composed of three independent ceramic layers and six leads, and therefore the cost is reduced.

6. The varistor of the present invention provides a larger mass and surface area for heat generation and dissipation, and thus less extra elements, for example, thermal cut-off (TCO) fuses, are necessary than the conventional.

In the above preferred embodiment, the leads 4*a*, 4*b*, 4*c* and 4*d* can be separated and properly connected to the electrodes by associating with additional wires. Alternatively, these leads 4*a*, 4*b*, 4*c* and 4*d* can be considered as portions of one or more leads; that is, the associated leads and wire are made a whole depending on customer's requirements or manufacturing processes.

What is claimed is:

1. A varistor, comprising three ceramic layers, six electrodes and a plurality of leads, wherein: the three ceramic layers are arranged in parallel and defined as a 1st varistor, a 2nd varistor and a 3rd varistor in order; the six electrodes are defined as a 1st electrode and a 2nd electrode respectively disposed on both sides of the 1st varistor; a 3rd electrode and a 4th electrode respectively disposed on both sides of the 2nd varistor; and a 5th electrode and a 6th electrode respectively disposed on both sides of the 3rd varistor; and the plurality of leads are properly connected to the electrodes to form a three- or single-phase varistor;

wherein the plurality leads are defined as a 1st lead with one end connected to the 1st electrode, a 2nd lead with one end connected to the 2nd electrode and the 3rd electrode, a 3rd lead with one end connected to the 4th electrode and the 5th electrode, and a 4th lead with one end connected to the 6th electrode.

2. The varistor as claimed in claim 1, wherein the ceramic layers are made of metal oxide powder.

3. The varistor as claimed in claim 1, further comprising a wire for conducting the 1st lead and the 4th lead, so that when a surge energy is conducted to the 1st varistor via the 1st lead and the 2nd lead, the 1st varistor will absorb the surge by transforming the electrical energy into heat.

4. The varistor as claimed in claim 1, further comprising a wire for conducting the 1st lead and the 4th lead, so that when a surge of electrical energy is conducted to the 2nd varistor via the 2nd lead and the 3rd lead, the 2nd varistor will absorb the surge by transforming the electrical energy into heat.

5. The varistor as claimed in claim 1, further comprising a wire for conducting the 1st lead and the 4th lead, so that when a surge of electrical energy is conducted to the 3rd varistor via the 3rd lead and the 4th lead, the 3rd varistor will absorb the surge by transforming the electrical energy into heat.

6. The varistor as claimed in claim 1, further comprising a wire for conducting the 1st lead and the 3rd lead, and a wire for conducting the 2nd lead and the 4th lead; so that the three ceramic layers will be effective as a whole.

7. A varistor, comprising three ceramic layers, six electrodes and a plurality of leads, wherein: the three ceramic layers are arranged in parallel and defined as a 1st varistor, a 2nd varistor and a 3rd varistor in order; the six electrodes are defined as a 1st electrode and a 2nd electrode respectively disposed on both sides of the 1st varistor; a 3rd electrode and a 4th electrode respectively disposed on both sides of the 2nd varistor; and a 5th electrode and a 6th electrode respectively disposed on both sides of the 3rd varistor; and the plurality of leads are properly connected to the electrodes to form a three- or single-phase varistor, and wherein the plurality of leads are defined as a 1st lead with two ends respectively connected to the 1st and the 6th electrodes, a 2nd lead with one end connected to the 2nd electrode and the 3rd electrode, and a 3rd lead with one end connected to the 4th electrode and the 5th electrode.

8. A varistor, comprising three ceramic layers, six electrodes and a plurality of leads, wherein: the three ceramic layers are arranged in parallel and defined as a 1st varistor, a 2nd varistor and a 3rd varistor in order; the six electrodes are defined as a 1st electrode and a 2nd electrode respectively disposed on both sides of the 1st varistor; a 3rd electrode and a 4th electrode respectively disposed on both sides of the 2nd varistor; and a 5th electrode and a 6th electrode respectively disposed on both sides of the 3rd varistor; and the plurality of leads are properly connected to the electrodes to form a three- or single-phase varistor, and wherein the plurality of leads are defined as a 1st lead with one end connected to the 1st electrode and another end connected to the 4th and the 5th electrode, and a 2nd lead with one end connected to the 6th electrode and another end connected to the 2nd and the 3rd electrode.

* * * * *

UNITED STATES PATENT AND TRADEMARK OFFICE

CERTIFICATE OF CORRECTION

PATENT NO. : 7,623,019 B2
APPLICATION NO. : 11/429073
DATED : November 24, 2009
INVENTOR(S) : Lang Rih Luo It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 535 days.

Signed and Sealed this

Fourteenth Day of December, 2010

David J. Kappos

David J. Kappos
*Director of the United States Patent and Trademark Office*